US005184710A

United States Patent [19]

Nakatani

[11] Patent Number: 5,184,710

[45] Date of Patent: Feb. 9, 1993

[54] ESCALATOR APPARATUS

[75] Inventor: Hiroshi Nakatani, Inazawa, Japan

[73] Assignee: Mitsubishi Denki Kabushiki Kaisha, Tokyo, Japan

[21] Appl. No.: 641,552

[22] Filed: Jan. 15, 1991

[30] Foreign Application Priority Data

Jan. 16, 1990 [JP] Japan ..... 2-4538

[51] Int. Cl.[5] ..... B66B 21/00

[52] U.S. Cl. ..... 198/328; 198/778

[58] Field of Search ..... 198/328, 333, 326, 778

[56] References Cited

U.S. PATENT DOCUMENTS

| | | | |
|---|---|---|---|
| 999,885 | 8/1911 | Seeberger | 198/328 |
| 4,411,352 | 10/1983 | Kettle | 198/328 |
| 4,662,502 | 5/1987 | Nakatani | 198/328 |
| 4,681,206 | 7/1987 | Sugita | 198/328 |
| 4,746,000 | 5/1988 | Nakatani et al. | 198/328 |
| 4,809,840 | 3/1989 | Nakatani | 198/328 |
| 4,883,160 | 11/1989 | Sansevero et al. | 198/328 |
| 4,884,673 | 12/1989 | Rivera | 198/328 |
| 4,895,239 | 1/1990 | Johnson et al. | 198/328 |
| 4,949,832 | 8/1990 | Sansevero | 198/328 |
| 4,953,685 | 9/1990 | Johnson | 198/328 |

FOREIGN PATENT DOCUMENTS 2325967 12/1974 Fed. Rep. of Germany .

*Primary Examiner*—Joseph E. Valenza
*Assistant Examiner*—Tuan N. Nguyen
*Attorney, Agent, or Firm*—Leydig, Voit & Mayer

[57] ABSTRACT

An escalator includes a main frame defining an elongated sloped circulating loop path having an upper load-bearing run and a lower return run and a plurality of steps disposed along the circulating loop path defined by a guide rail mounted to the main frame for guiding the steps. A transmission mechanism is disposed on the steps for transmitting a power from a drive unit. Each of the steps has a pin and a slot formed in an edge portion of the step to extend along the edge portion of the step. One end of a link is pivotally connected to the pin of the step and the other end of the link is slidably engaged by the slot in the link of the neighboring step, whereby the steps are connected together so that the distance between the respective steps can be varied.

44 Claims, 19 Drawing Sheets

ESCALATOR APPARATUS

BACKGROUND OF THE INVENTION

This invention relates to an escalator apparatus and, more particularly, to an escalator apparatus in which a plurality of segment-shaped steps are disposed along a circular, sloped, endless loop defining a circulating path having an upper load bearing run, a lower return run, and turn-around portions.

FIGS. 16 to 20 illustrate one example of a conventional circular escalator disclosed in Japanese Patent Publication No. 62-33196. In these figures, reference numeral 1 indicates a main frame defining thereon a circulating travel path along which a plurality of steps 3 are conveyed, 2 indicates a step loop having a plurality of steps connected into an endless loop, the step loop 2 having an upper load-bearing run, a lower return run, a lower end, a turn-around portion 2*a* and an upper end turn-around portion 2*a'*. The turn-around portions 2*a* and 2*a'* are disposed in lower and an upper horizontal portions 2*b* and 2*b'*, respectively, and the load-bearing run and the return run are sloped to extend between the lower and the upper horizontal portions 2*b* and 2*b'* and curved in plan along an arc having a constant radius of curvature R as illustrated in FIG. 17.

In order to drive the steps 3 thus constructed, a rack 4*a* secured to a rack mount 4 is mounted to the opposite ends of the step 3, and a pinion gear 5 in mesh with the rack 4*a* is provided.

Further, the interconnection between each of the steps 3 is achieved by the application of a two-link speed changing mechanism as illustrated in FIGS. 19 and 20. That is, the two-link speed changing mechanism is composed of a first roller 7 rotatably mounted to the step 3 and guided by a first guide rail 6 for guiding the step 3, a second roller 9 guided by a second guide rail 8 for changing and maintaining predetermined intervals and predetermined level differences between the steps, and links 10 connecting the above rollers 7 and 9. With this construction, it is possible to drive the steps 3 or the step loop 2 smoothly with the inner and the outer sides of the steps 3 moved along a constant radius of curvature as viewed in a horizontal projection. Reference numeral 11 indicates a rail supporting rolling rollers 12 rotatably mounted to the step 3, 3*a* indicates the tread of the step 3, and 3*b* indicates a riser defined by a conical surface and disposed on the rear end of the step 3. The riser 3*b* and the tread 3*a* have formed thereon a plurality of cleats.

Another example of a conventional circular escalator which is disclosed in Japanese Patent Publication No. 62-33197 is illustrated in FIGS. 21 to 24. In these figures, the conveyer circulating path 1 on the main frame is arranged so that the radius of curvature on a horizontal plane varies in accordance with the variation of the slope angle.

FIG. 21 is an enlarged plan view of one part of FIG. 16, FIG. 22 is a side view of FIG. 21 and FIG. 23 is a sectional view of FIG. 21. In these figures, reference numerals 13 and 14 respectively indicate a first and a second outer guide rail disposed radially outside of the circulating path 1, 15 and 16 respectively indicate a first and a second inner guide rail disposed radially inside of the circulating path 1, and reference numeral 17 indicates a guide rail disposed along the center of the circulating path 1.

Reference numeral 18 indicates a step axle disposed at one end portion of the step 3 extending in the widthwise direction of the step 3 for supporting the step 3, the step axle 18 having at its opposite end portions a pair of main rollers 19 for rolling along the first outer guide rail 13 and the first inner guide 15, respectively. Reference numeral 20 indicates a pair of follower rollers disposed at both sides of the other end of step 3, the follower rollers 20 rolling along the second outer guide rail 14 and the second inner guide rail 16.

Reference numeral 21 indicates a shoe disposed on the center of the backside of the step 3. The shoe 3 is in contact with the guide rail 17 to prevent the swinging motion of the step 3.

Also, as best shown in FIG. 23, the step axle 18 is generally sloped so that the outer main roller 19 is positioned at a higher level than the inner main roller 19 in the load-bearing run, and the outer and the inner rails 13 and 15 are correspondingly positioned, whereby each of the steps 3 is maintained in a horizontal position by the rollers 19 and 20 in the load-bearing run and the return run.

Reference numeral 22 indicates an outer chain connected to each step axle 18 rotatably in a verticla and a horizontal direction at the radially outside portion of the steps 3, and 23 indicates an inner chain connected to each step axle 18 at the radially inside portion of the steps 3 similarly to the outer chain 22.

Further, FIG. 24 is a side view illustrating a turn-around portion of the steps 3 illustrated in FIG. 16, in which reference numeral 24 indicates a drive unit, 25 indicates an outer gear meshing with the outer chain 22, 26 indicates an inner gear meshing with the inner chain 23, and each of gears 25 and 26 is connected to the drive unit 24 through a drive chain 27.

In the conventional escalator constructed as described above, the drive force of the drive unit 24 is transmitted to the outer and inner gears 25 and 26 through the drive chain 27 to rotate each of the gears 25 and 26. This causes the outer and the inner chains 22 and 23 meshing with the gears 25 and 26 to be moved to drive the steps 3. At this time, each step 3 is limited as to the distance between the neighboring step 3 by each of the chains 22 and 23.

On the other hand, each of the chains 22 and 23 receives the drive force for driving the steps 3 and limiting the distance between the steps 3, thereby bearing the loads of the steps 3 and passengers thereon positioned at a level lower than the chains. Therefore, each of the chains 22 and 23 is subjected to elongations due to the loads.

As a counter measure for this, the position of the chains 25 and 26 is made changeable, particularly at the lower turn-around portion, in the direction of elongation of the chains 22 and 23 (in the right-hand direction in FIG. 24), so each of the chains 22 and 23 is in mesh with the gears 25 and 26 even when some elongation occurs in the chains 22 and 23.

Since the conventioanl apparatus is constructed as above, in the first example, it is necessary to provide a first guide rail 6 and a second guide rail 8 for guiding the first roller 7 and the second roller 9, respectively, and the configuration and the dimensions of the guide rails 6 and 8 must be highly precise to produce the necessary differential between the inner and outer side speeds of the steps 3. Therefore, the mechanism is complicated and must be highly precise, making its manufacture difficult and costly and making the reliability of the system low because of the above complexity.

In the second example of the conventional escalator apparatus, the amount of elongation of each of the chains 21 and 22 is not uniform and, particularly in a curved or circular escalator apparatus, the amounts of elongation of the outer chain and the inner chain are often different, the difference between the elongations of the outer and the inner chains becomes large as the chain elongation becomes large, and the meshing conditions between the gears 25 and 26 and the chains 21 and 22 at the lower turn-around portion is degraded, often resulting in undesirable states in the driving of the steps 3. Also, since the chains 21 and 22 serve not only to transmit drive force to the steps 3 but also to limit the distance between the steps 3, the elongation of the chains 21 and 22 causes the gap between the steps 3 to disadvantageously increase.

SUMMARY OF THE INVENTION

Accordingly, one object of the present invention is to provide an escalator apparatus free from the above-described problems of a conventional escalator apparatus.

Another object of the present invention is to provide an escalator apparatus in which the inner and outer sides can be smoothly rotated without the need for a dual link type speed changing mechanism.

Another object for the present invention is to provide an escalator apparatus in which the above-discussed increase of the gap betweeen the steps is prevented and the transmission of drive force to the steps is maintained in a good condition.

With the above objects in view, the escalator apparatus of the present invention is characterized by a plurality of links disposed on side portions of each step for bridgingly connecting the steps. One end of the link is connected to a rotatable step axle disposed at a side surface of the step, and the other end of the link is slidably connected to a slot formed in an edge portion of a neighboring step to extend along an edge portion of the step. Alternatively, the other end of the link may be provided with an elongated slot slidably engageable with a pin disposed at an edge portion of a neighboring step for allowing a distance between the adjacent steps to change.

In another embodiment, the escalator apparatus of the present invention comprises a plurality of links disposed on side portions of each step to bridgingly connect the steps, and a drive force transmission means rotatably mounted to each of the steps and bridging between each of the steps for transmitting drive power from a drive unit to the steps. One end of the links is connected to a step axle rotatably mounted to side faces of the step, and the other end of the links is slidably connected to an arcuated slot having its center on the step axle of the neighboring step and formed in an edge portion of a neighboring step to extend along an edge portion of the step.

The escalator apparatus of the present invention may comprise a main frame defining an elongated sloped circulating loop path having an upper load-bearing run and a lower return run and a plurality of steps disposed along the circulating loop path on the main frame. A transmission mechanism is disposed on the steps for transmitting a drive force form a drive unit and a guide rail is mounted to the main frame to extend along the circulating path for guiding the steps which are connected by a link. Each of the steps has a link engaging portion which may be a pin for rotatably supporting one end of the link and a slot formed in an edge portion thereof to extend along the edge portion of the step slidably engaging the other end of the link of the neighboring step so that a distance between the respective steps are variable. Alternatively, the other end of the link may have formed therein a slot engaging the pin on a neighboring step.

Since the escalator of the present invention is constructed as described above, the neighboring steps can be substantially vertically displaced relative to each other owing to the mechanism composed of the link, the step axle and the groove. Also, the positional control of the step by limiting the distance between the steps can be achieved by the links.

BRIEF DESCRIPTION OF THE DRAWINGS

The present invention will become more readily apparent from the following detailed description of the preferred embodiments to the present invention taken in conjunction with the accompanying drawings, in which.

DESCRIPTION OF THE PREFERRED EMBODIMENTS

Figure 1:
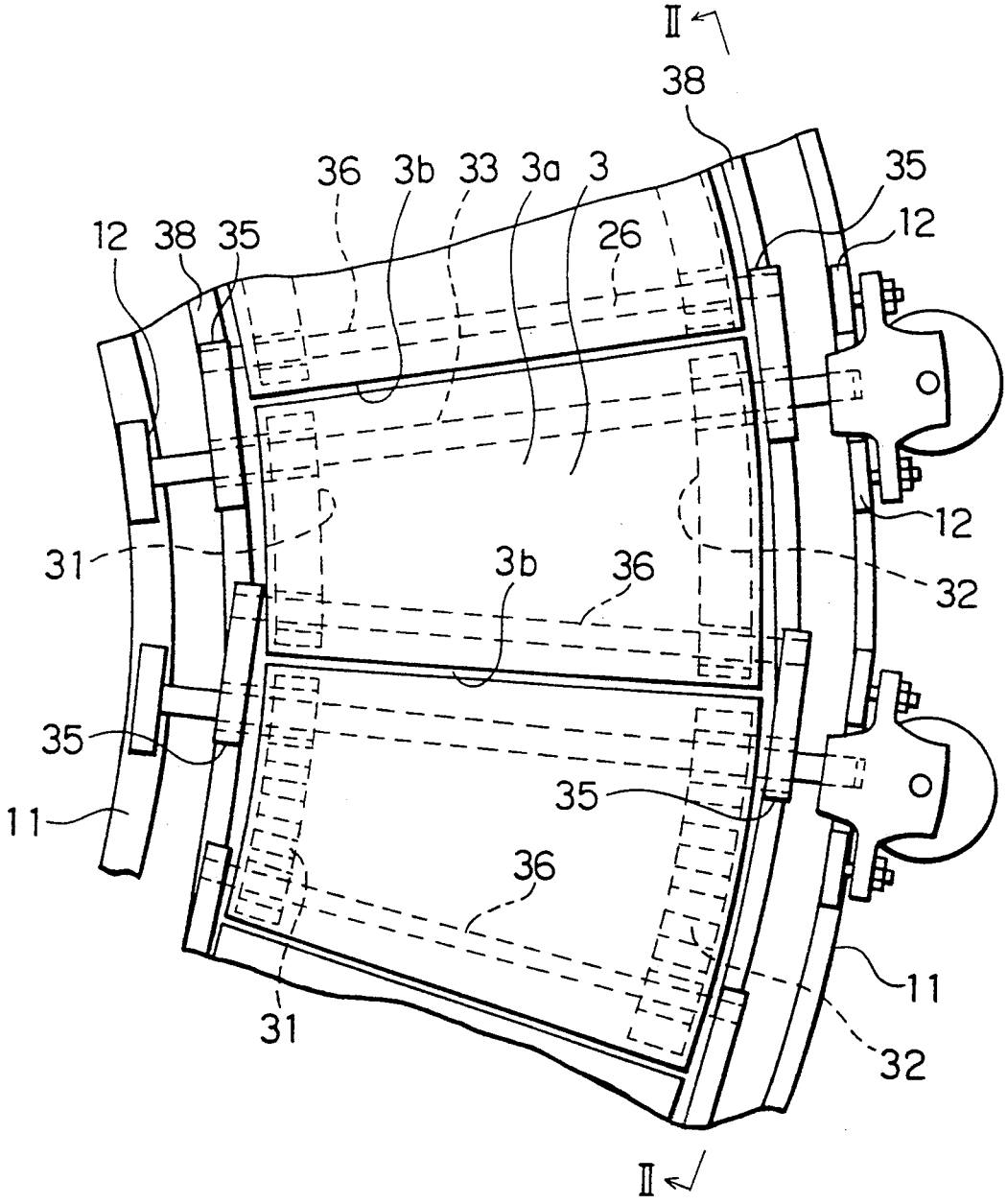
FIG. 1 is a fragmental plan view of an embodiment of the escalator apparatus of the present invention.

The present invention will now be described in conjunction with the embodiment illustrated in the accompanying drawings, in which the same reference numerals indicate identical or corresponding components.

In FIGS. 1 to 8 illustrating one embodiment of the escalator apparatus of the present invention, reference numerals 31 and 32 indicate inner and outer brackets, respectively, mounted to the inner and outer sides of the lower portion of the step 3 for supporting the step 3. One side of each of the inner and outer brackets 31 and 32 has mounted thereon a pin or step axle 33, and the other side of the each bracket 31 or 32 has a slot portion or a groove 34 extending vertically relative to the tread 3*a* of the step 3. Reference numeral 35 indicates a link having one end rotatably mounted to the step axle 33 and the other end slidably engaging the slot portion 34 through a pin 36. Reference numeral 37 indicates spiral-shaped racks disposed below the brackets 31 and 32, and reference numeral 38 indicates a follower rail on which follower roller 39 disposed on the lower portion of the brackets 31 and 32 rolls.

Figure 3:
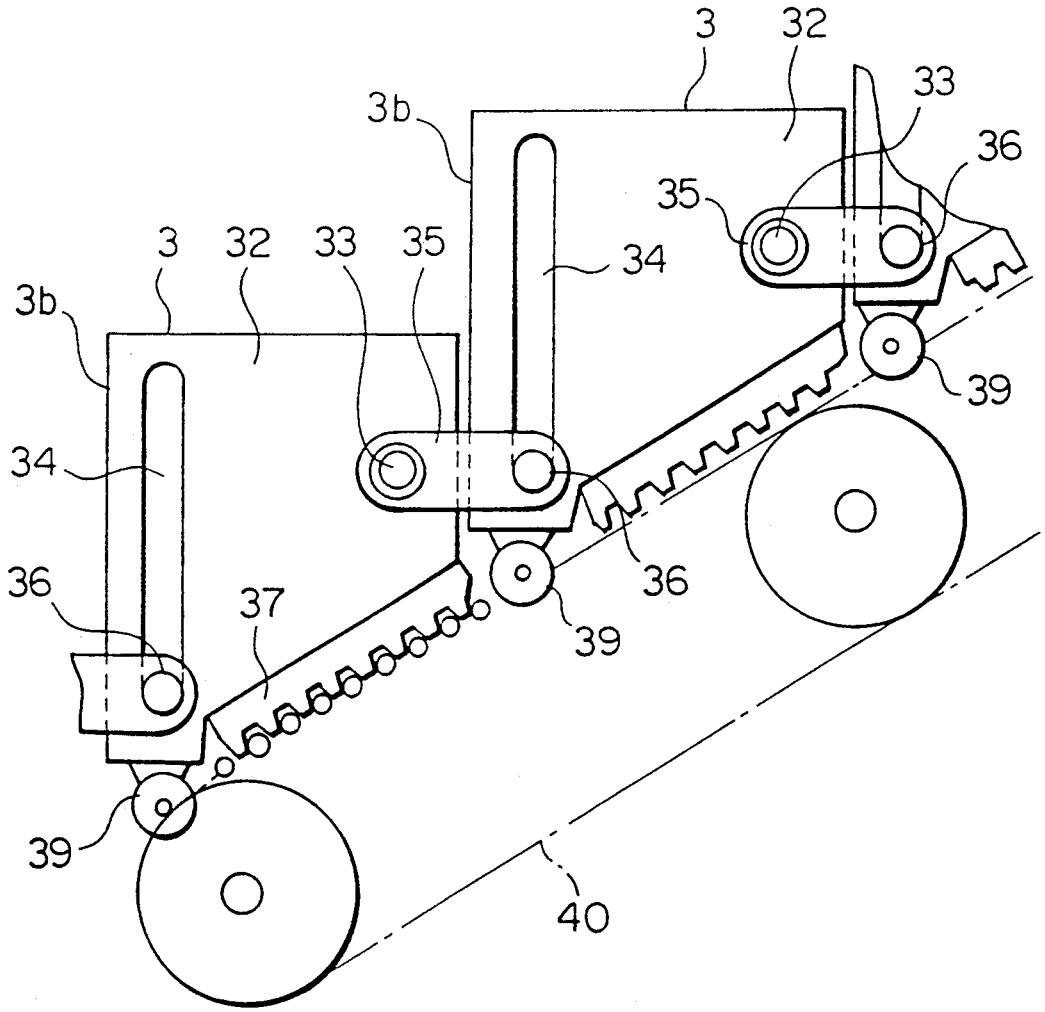

The operation of the above-described embodiment will now be described. As illustrated in FIG. 3, in the step unit 2, when a chain 40 for example which is in engagement with the rack 37 is driven, the brackets 31 and 32 on the sloped portion are driven along the follower rail 38 through the follower rollers 39. The driving of the brackets 31 and 32 of the steps 3 which are not on the sloped portion, i.e., the steps 3 on the upper and the lower horizontal portions and on the turn-around portions, is achieved by the drive force applied to and transmitted to the step through the links between the steps.

Figure 2:
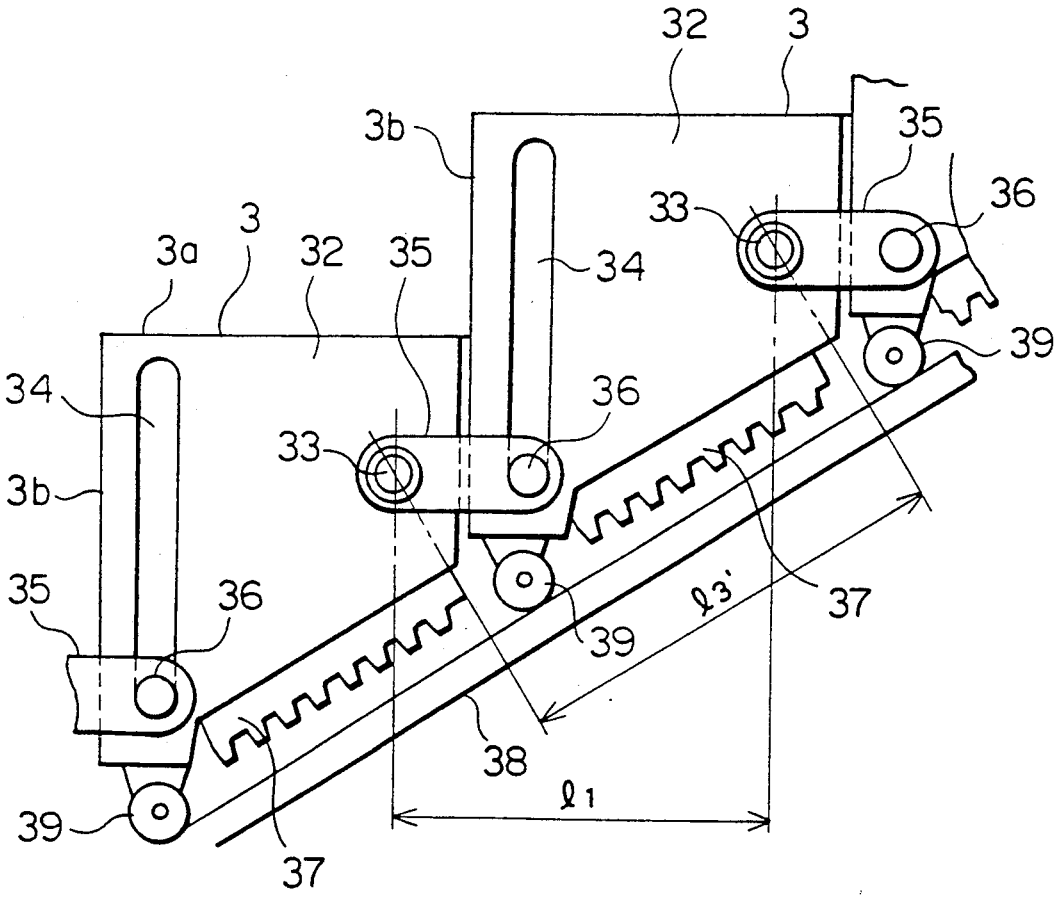
FIGS. 2 and 3 are side views of the steps taken along line II—II of FIG. 1.

In the sloped portion, as illustrated in FIGS. 2 and 3, the pin 36 is in the lower portion of the slot 34 to connect the steps 3 in the stepped-configuration. Also, the follower rail 38 for the roller 39 on the inner bracket 31 is arranged to have different dimensions from the follower rail 38 for the roller 39 of the outer bracket 32 as illustrated in FIG. 5, for example, so that the step 3 is allowed to rotate about the common center of rotation, whereby the steps 3 are not tilted and allowed to rotate smoothly.

Figure 4:
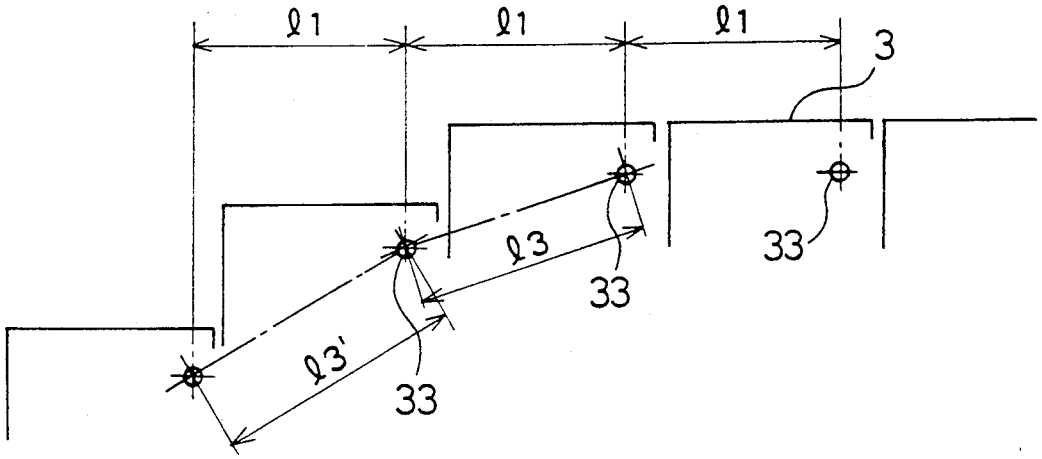
FIGS. 4 and 5 are schematic side views similar to FIGS. 2 and 3 but illustrating the transition positions from the sloped portion to the horizontal portion.
Figure 5:
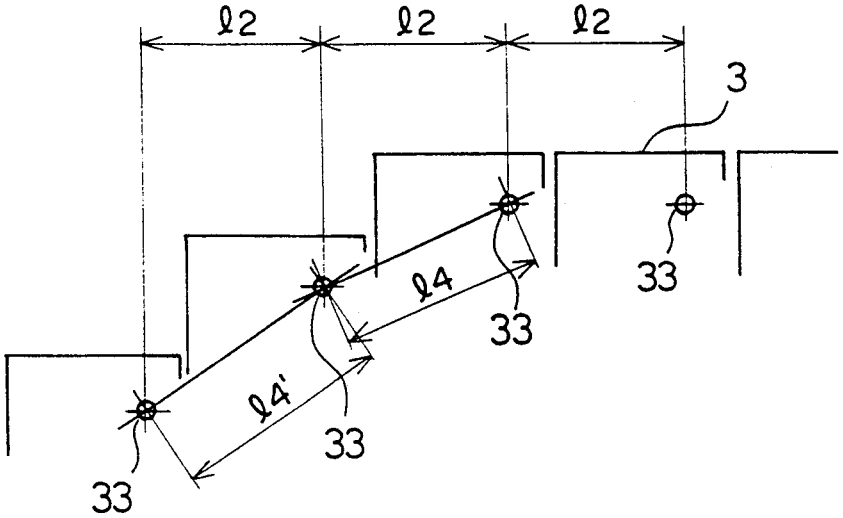

When the steps 3 moves from the sloped portion to the horizontal portion, as shown in FIGS. 4 and 5 illustrating the steps 3, step pitches $l_1$ and $l_2$ in the horizontal direction are constant at the step inner and outer sides because of the link 35 and the slot portion 34 and, therefore, the vertical distance between the pins 33 varies in accordance with the difference in the levels of the steps which varies in response to the position of the steps, whereby the center of rotation always stays in the same position.

Figure 6A:
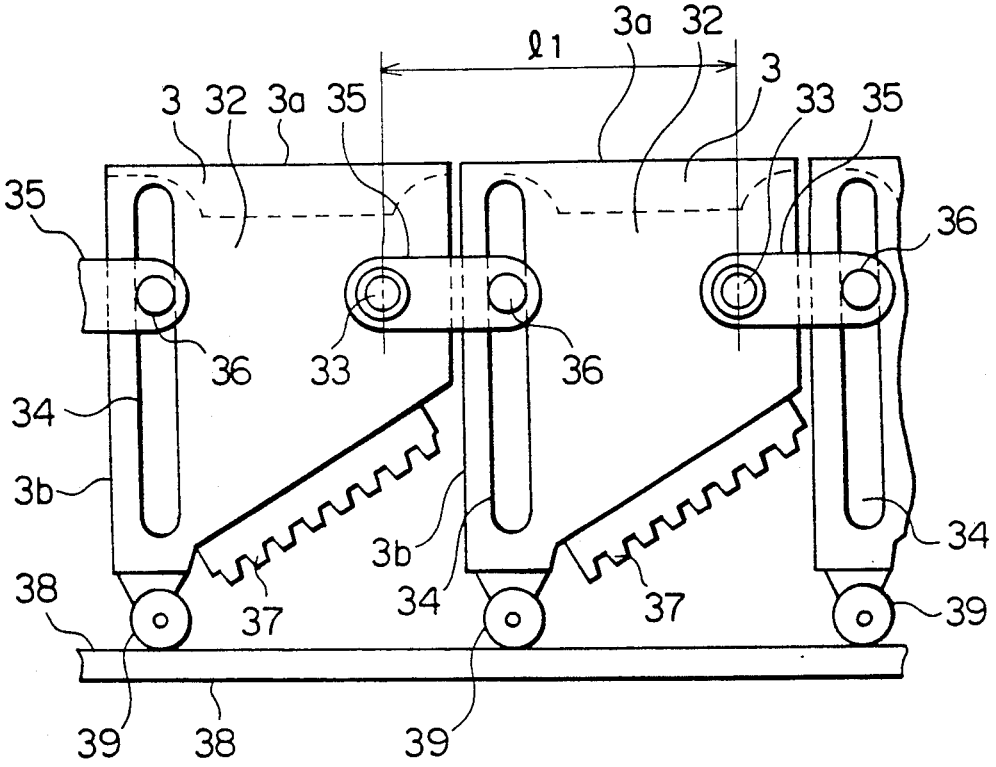
FIGS. 6*a*, 6*b* and 6*c* are side views of the steps of various embodiments taken along line II—II of FIG. 1 illustrating the positions in the horizontal portion and in the sloped portion.

Thus, when the movement of the steps 3 is horizontal, the steps 3 move along the horizontal follower rail 38 as illustrated in FIG. 6, and the steps 3 are driven by the drive force transmitted through the link 35 and applied to the chain 40 at the sloped portion. In this case, the pin 36 is positioned in the upper portion of the slot portion 34.

When the steps 3 are being moved from the upper horizontal portion to the turn-around portion, the steps 3 are tilted by the inner and outer follower rails 38 which are arranged such that the inner bracket 31 is lowered so that the inner and outer brackets 31 and 32 rotate about the same center of rotation, whereby the rotation of steps 3 in the turn-around portion is smooth.

Figure 8:
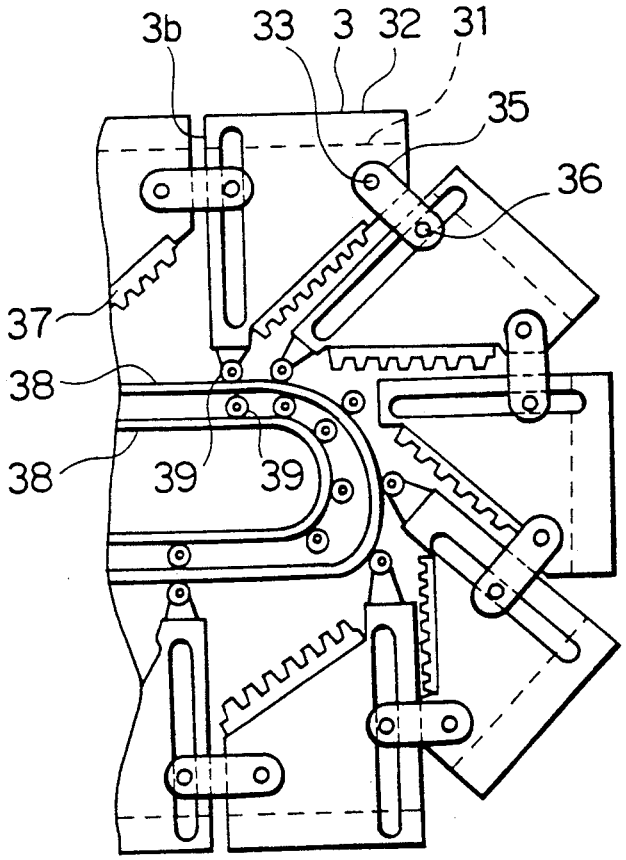
FIG. 8 is a side view of the escalator steps in the turn-around portion.

Further, in the turn-around portion, as illustrated in FIG. 8, the inner and the outer brackets 31 and 32 are arranged so that the steps 3 are tilted and rotated about the same center of rotation, the follower rail 38 for the inner bracket 31 has a configuration different from that of the follower rail 38 for the outer bracket 32, whereby the turning-around of the steps 3 can be smoothly achieved.

While the step unit 2 is driven by the chain 40 in the above embodiment, the chain 40 need not be used and any suitable drive unit may be used.

Figure 6B:
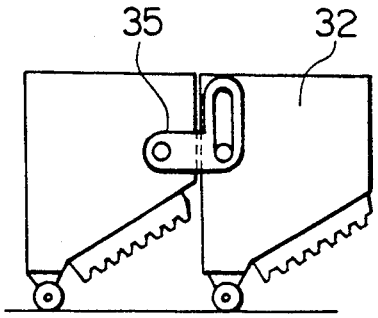
Figure 6C:
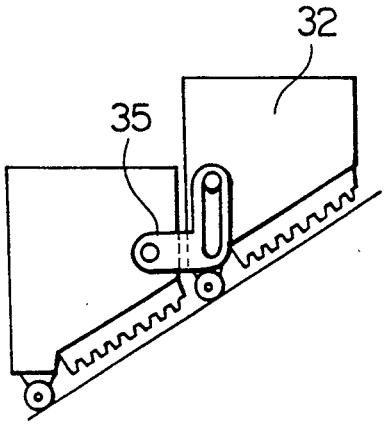
Figure 7:
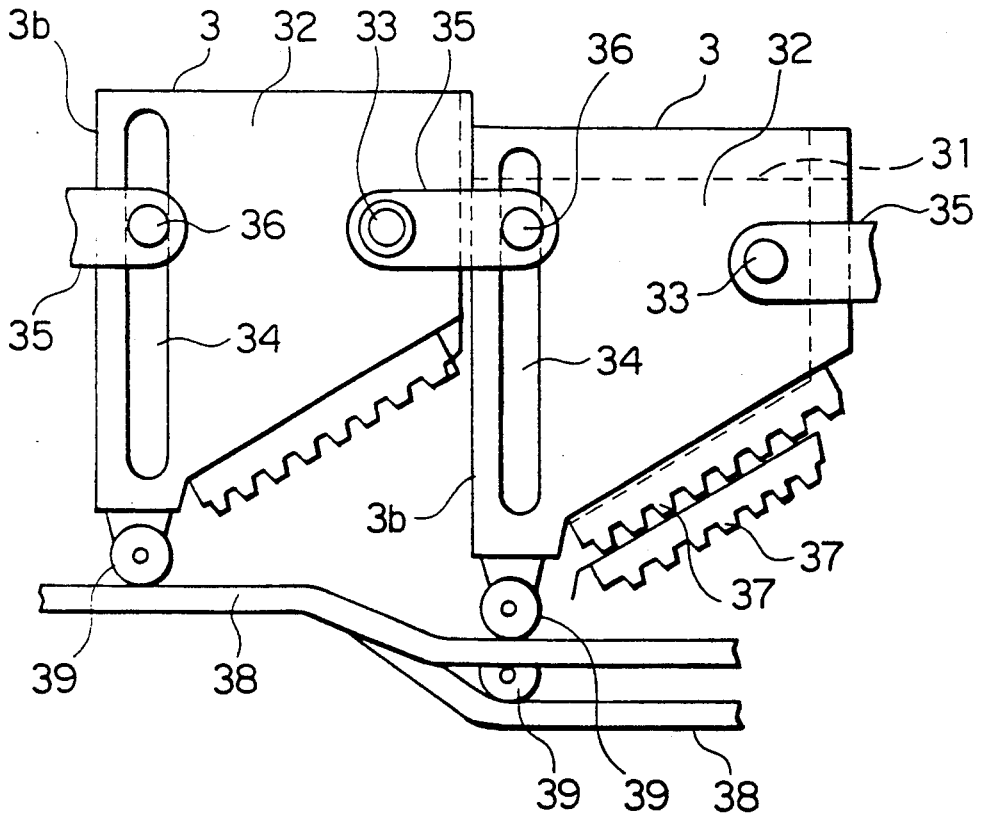
FIG. 7 is a side view of the escalator steps in the transition position from the horizontal portion to the turn-around portion.

Also, while the pin 33 which is secured to the brackets 31 and 32 and which rotatably supports the link 35 is provided, any suitable means for rotatably connecting the link 35 to the brackets 31 and 32 may be used, and the pin 33 may be modified so as to extend through the inner and the outer brackets 31 and 32. That is, the link serves to transmit the force between the brackets while allowing the positional setting of the moving brackets and to limit the movement of the steps in the horizontal direction. Further, while the slot is described and illustrated as being a slot 34 formed in the brackets 31 and 32 for engagement by the pin 36 secured to the link 35, the arrangement is not limited to this and may be replaced with an elongated slot formed in the end portion of the link 35 to extend perpendicularly to the tread, and the elongated slot may be engaged by a pin mounted to the brackets 31 and 32 as illustrated in FIGS. 6*b* and 6*c*. Alternatively, the pin 36 may be replaced with a shaft common to the inner and the outer brackets 31 and 32.

Since the present invention is constructed as described above, the steps can be smoothly moved without the need for the dual link type speed changing mechanism, and since the rack 37 is provided on each of the brackets 31 and 32, the steps 3 can be driven in the intermediate portion, so that the present invention can be advantageously applicable to a high lift escalator apparatus.

Figure 9:
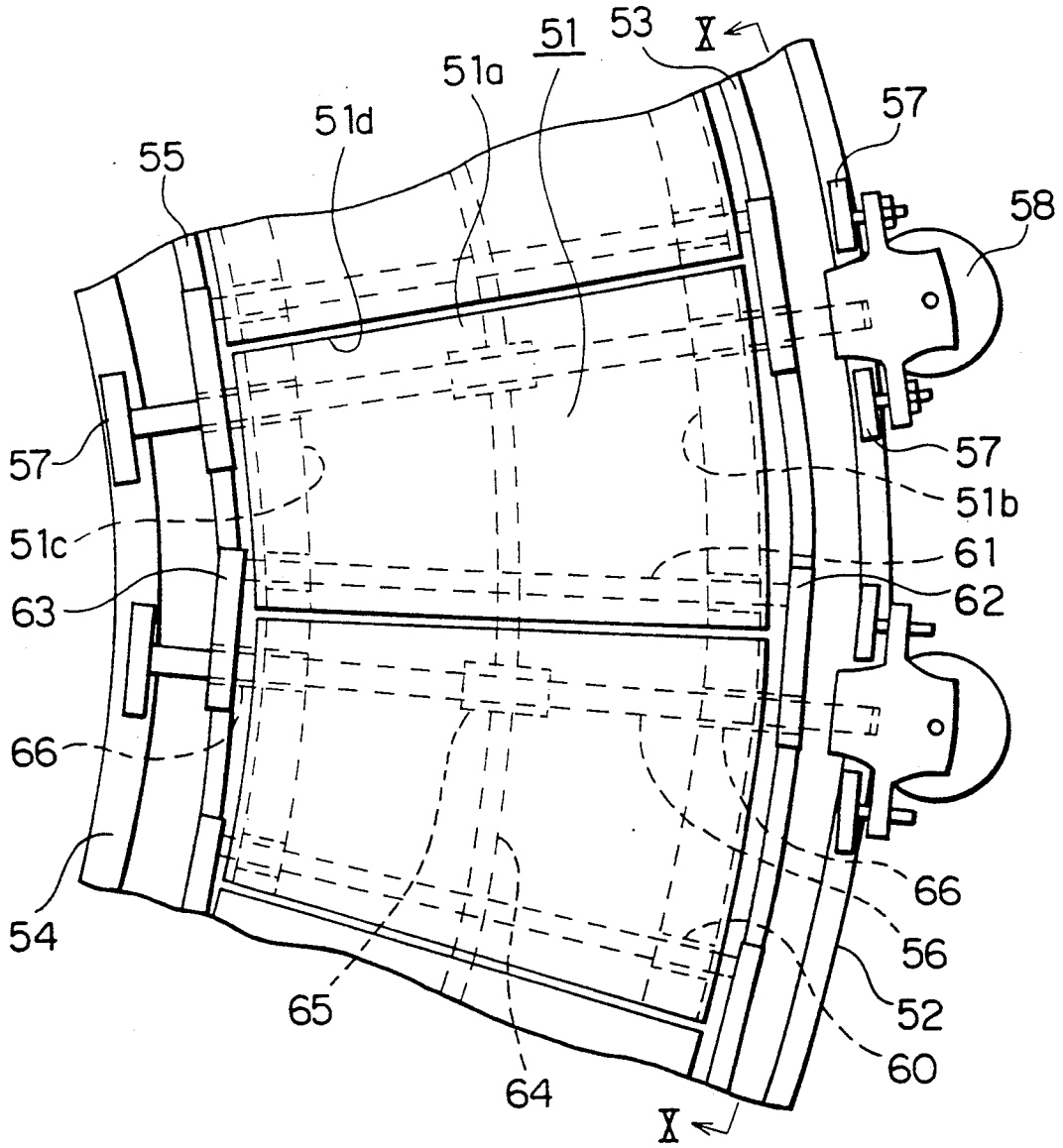
FIG. 9 is a fragmental plan view of an embodiment of the escalator apparatus of the present invention.
Figure 10:
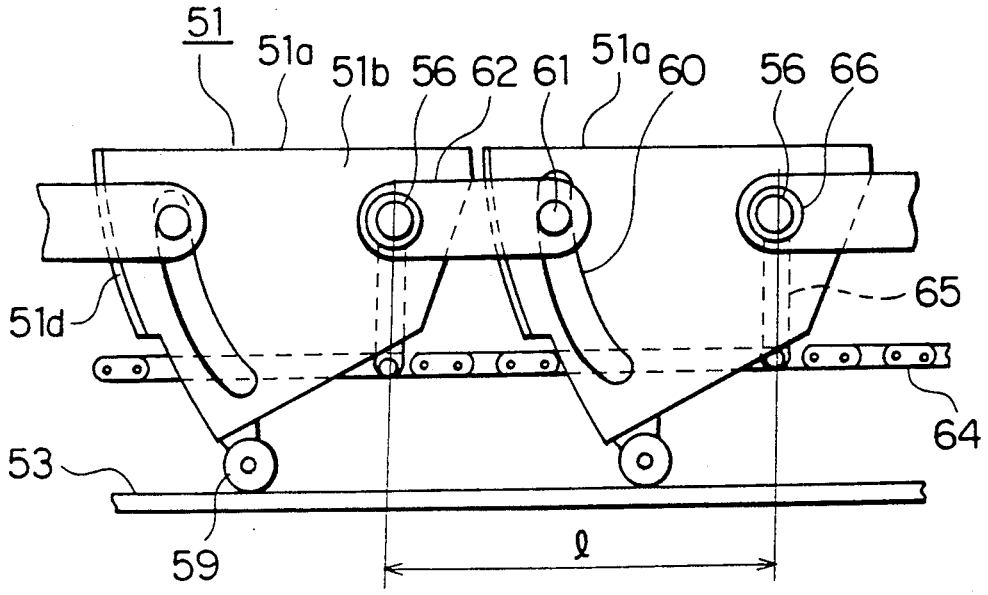
FIG. 10 is a side view of the escalator steps in the horizontal portion taken along line X—X of FIG. 9.
Figure 11:
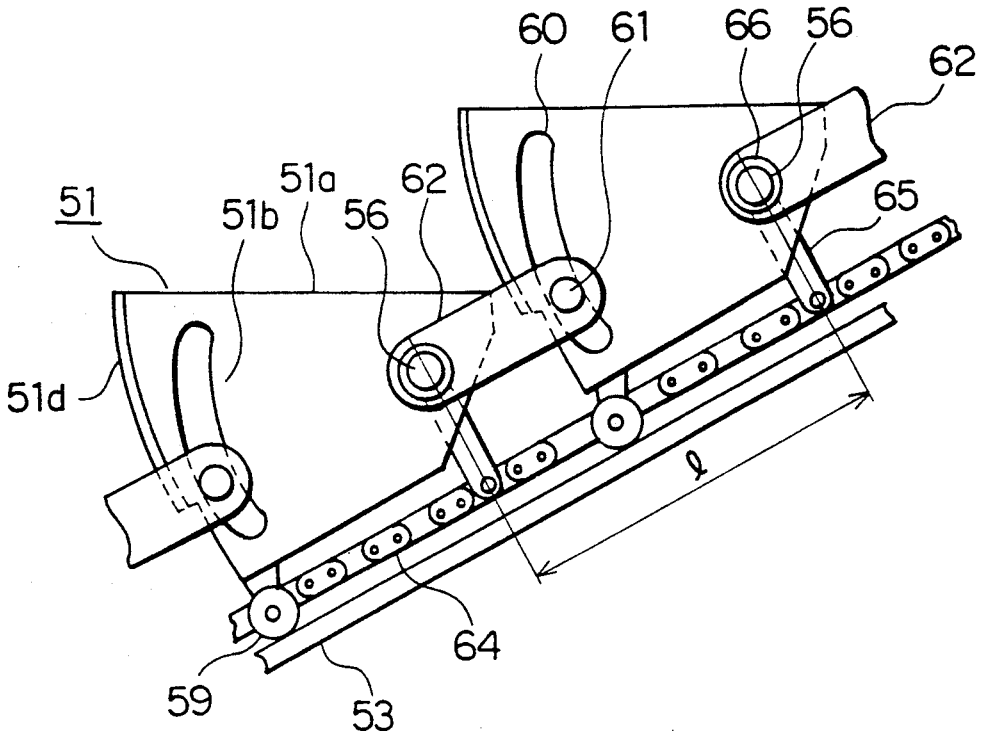
FIG. 11 is a side view of the steps taken along line X—X of FIG. 9 illustating the sloped portion.

FIGS. 9, 10 and 11 illustrate another embodiment of the escalator of the present invention, in which reference numeral 51 indicates a plurality of segment-shaped steps disposed along the circulating path 1. Each step 51 comprises a tread board 51*a* having a plurality of concentric arc-shaped cleats (not shown), an outer bracket 51*b* disposed on the radially outer side of the step 51 and an inner bracket 51*c* disposed on the radially inner side, and a conical riser 51*d* having a radius of curvature which increases from the inner side to the outer side. The riser 51*d* has formed therein cleats (not shown) engaging the cleats on the tread board 51*a* of the neighboring step.

Reference numerals 52 and 53 indicate a first and a second outer guide rail disposed on the radially outer side of the circulating path 1, and 54 and 55 indicate a first and a second inner guide rail disposed on the radially inner side of the circulating 1. The first outer guide rail 52 and the first inner guide rail 54 are disposed without any level difference therebetween. Also, the second outer guide rail 53 and the second inner guide rail 55 are disposed without any level difference therebetween. Further, each of the rails 52 to 55 has a radius of curvature that varies in accordance with the slope angle as in the conventional design.

Reference numeral 56 indicates a step axle mounted to each step 51 along the widthwise direction of the tread board 51*a* parallel to the tread board 51*a*, each step axle 56 extending through the outer and inneer brackets 51*b* and 51*c*, respectively. Reference numeral 57 indicates drive rollers, two drive rollers being rotatably mounted to the outer end portion of the step axle 56 and one drive roller being rotatably mounted to the inner end of the step axle 56, and the drive rollers 57 are guided and rotated by the first outer guide rail 52 and the first inner guide rail 54. Reference numeral 58 indicates a side roller rotatably mounted to the outer end portion of the step axle 56 for rolling along a side surface of the circulating path 1 to support a centrifugal force on the step 51. Reference numeral 59 indicates a pair of follower rollers mounted to the lower portion of the step 51 for being supported and guided by the second outer guide rail 53 and the second inner guide rail 55.

Reference numeral 60 indicates an arcuate, elongated slot formed in the end portion of each of the outer and the inner brackets 51*b* and 51*c*, the elongated slot 60 being formed in an arc having its center on the step axle 56. Reference numeral 61 indicates a slidable shaft extending through the slots 60 in the outer and the inner brackets 51*b* and 51*c* and slidable along the slots 60, and reference numerals 62 and 63 are an outer and an inner link, respectively, each rotatably attached at one end to the step axle 56 and at the other end to the end portion of the slidable shaft 61 extending through the slots 60 of the neighboring step 51. These outer and the inner links 62 and 63 limit the distance between the steps 51. Also, all of the outer links 62 have equal length and all the inner links 63 have equal length.

Reference numberal 64 indicates a drive force transmitting unit or a step chain disposed continuously along the center of the steps 51 for driving the steps 51, the step chain 64 being rotatably mounted to each of the steps 51 through a metal fitting 65. Reference numeral 66 indicates a bearing.

Figure 12:
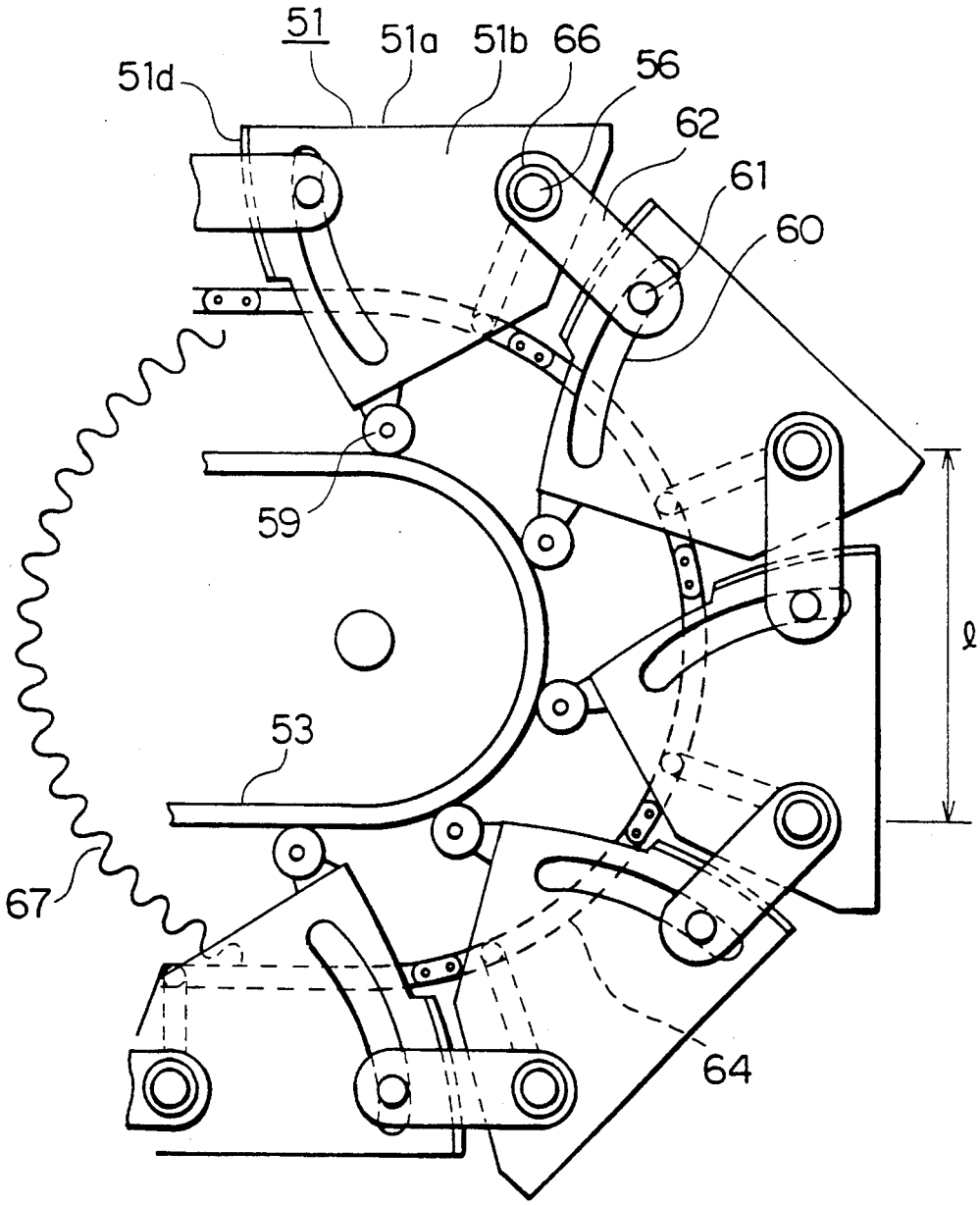
FIG. 12 is a schematic side views similar to FIG. 9 but illustrating the position in the turn-around portion.
Figure 13:
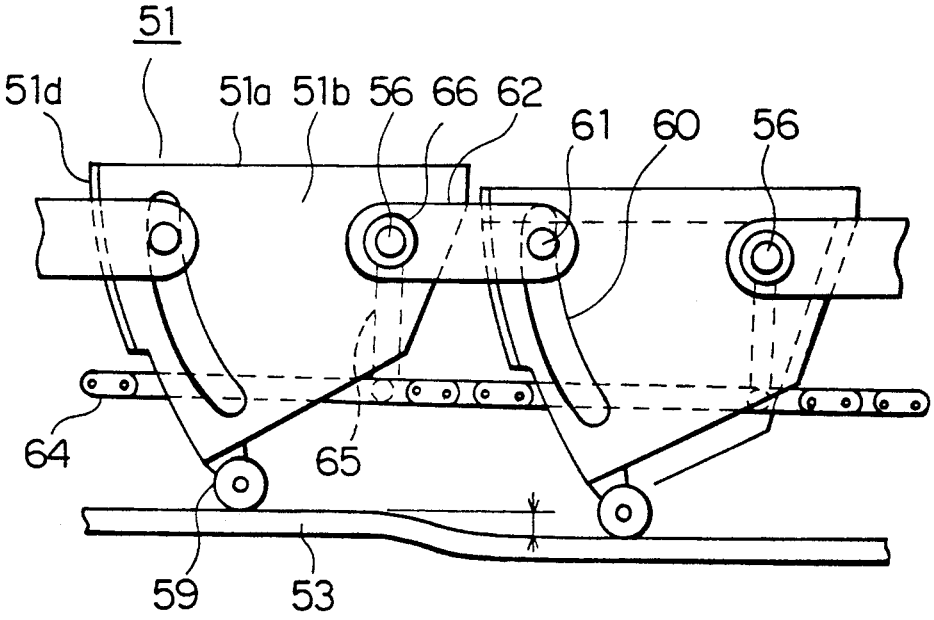
FIG. 13 is a side view of the escalator steps in the transition position from the horizontal portion to the turn-around portion.

In FIG. 12, reference numeral 67 indicates a sprocket wheel driven by the drive unit 24 which may be of a conventional design, the sprocket wheel 67 having the step chain 64 wound and engaged therearound.

With the above-described embodiment of the curved escalator apparatus of the present invention, as the sprocket wheel 67 rotates, the step chain 64 and the steps 51 are driven. Also, in the turn-around portion, each step 51 turns around in a cone-shaped track in which the track of the radially inner side of the step is shorter than the track of the radially outer side of the step. Therefore, during turning-around operation, the cleats of the riser 51*d* disengage from the cleats on the tread board 51*a* of the neighboring step. In order to disengage the cleats as above-described, a stepped portion is provided in the first and the second outer guide rails 52 and 53 at the transition portion between the horizontal portions 2*b* and 2*b'* and the turn-around portion as illustrated by dashed lines in FIG. 12.

Also, in this transition portion, the first and the second inner guide rails 54 and 55 are provided with a larger stepped portion (not shown) larger than those of the outer guide rails 52 and 53 in order to disengage the cleats and to guide the steps into the cone-shaped track.

On the other hand, the steps 51 are each connected to each other by the outer and the inner links 62 and 63, so that the distance between the steps 51, i.e., the distance l between the step axles 56 is constant.

Figure 14:
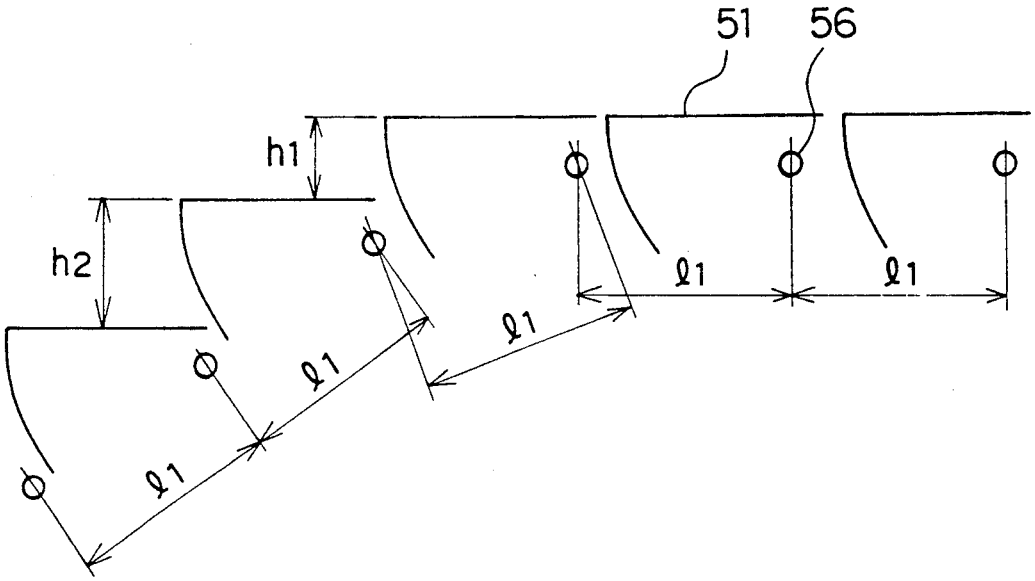
FIGS. 14 and 15 are schematic diagrams of the escalator steps for explaining the displacement of the steps in the outer and inner circumferential sides.
Figure 15:
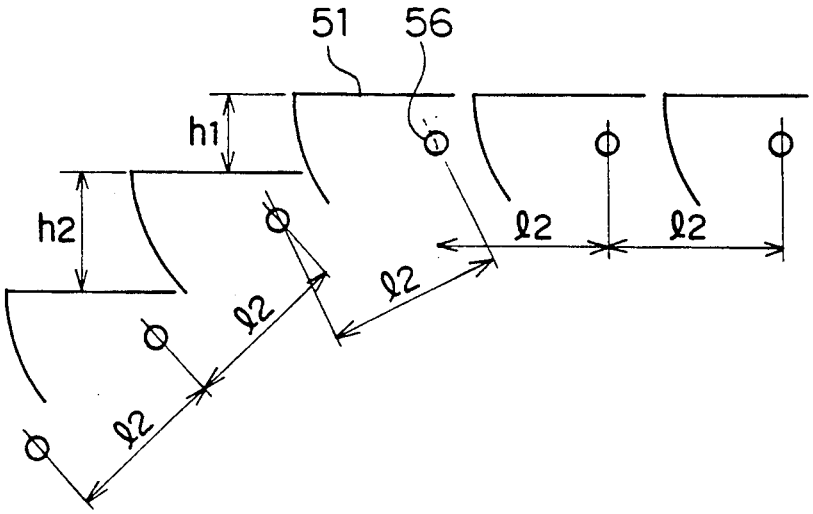
Figure 16:
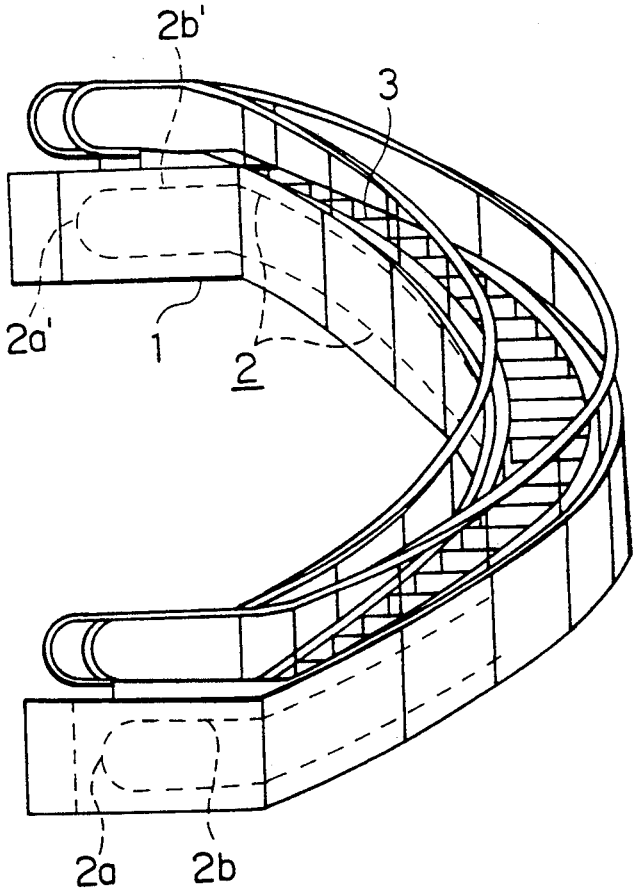
FIG. 16 PRIOR ART
FIG. 16 is a front view of a curved escalator apparatus.
Figure 17:
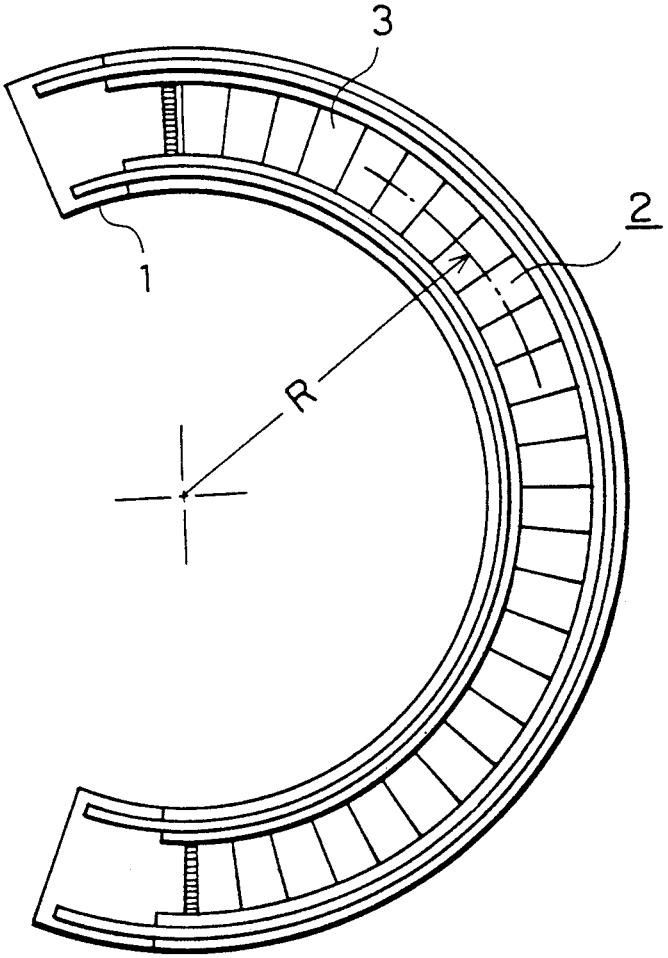
FIG. 17 PRIOR ART
FIG. 17 is a plan view of the escalator illustrated in FIG. 16.
Figure 18:
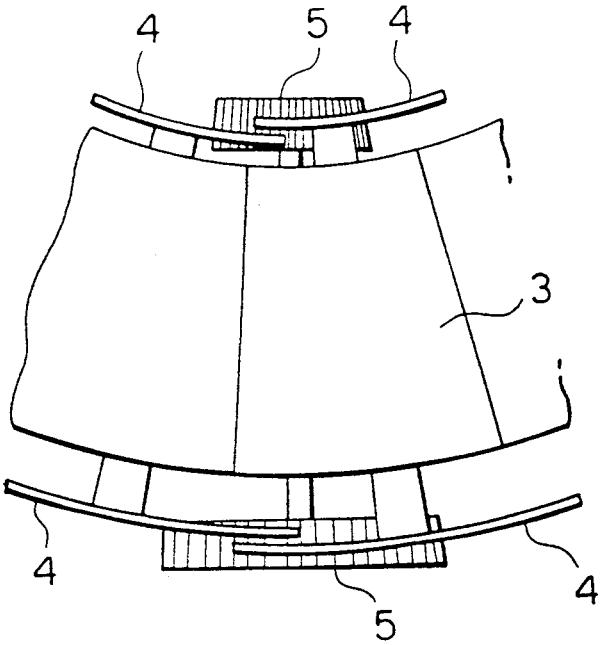
FIG. 18 PRIOR ART
FIGS. 18 and 19 are partial plan views of one example of the conventional circular escalator apparatus.
Figure 19:
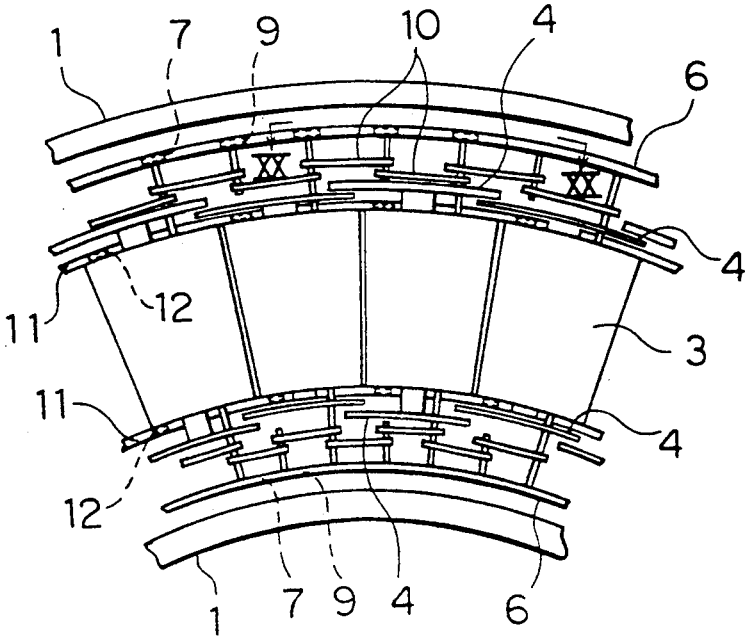
FIG. 19 PRIOR ART
Figure 20:
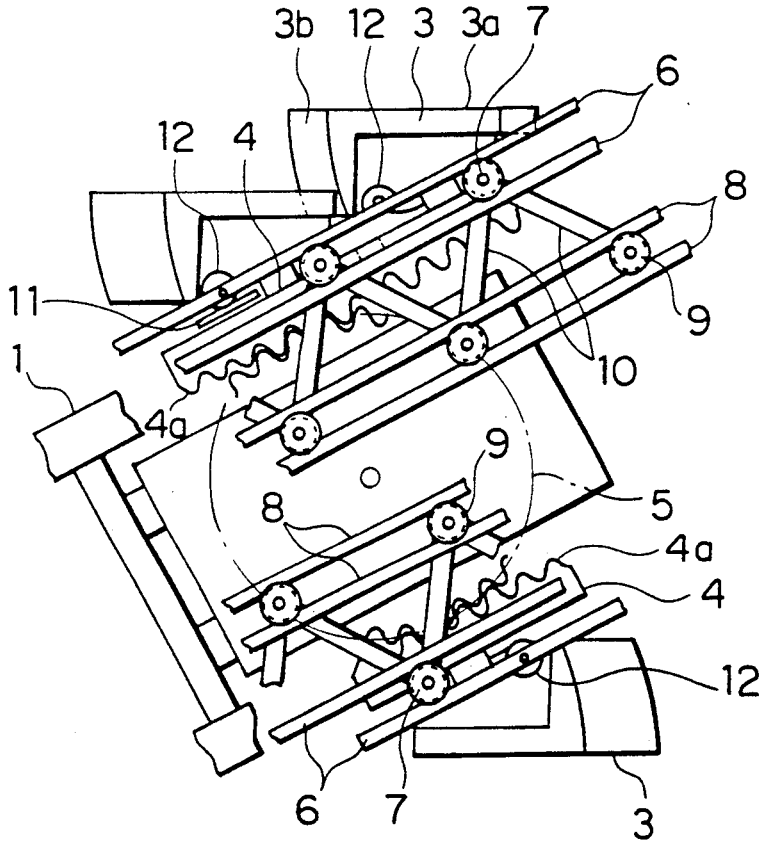
FIG. 20 PRIOR ART
FIG. 20 is a schematic side view of the escalator steps taken along line XX—XX of FIG. 19.
Figure 21:
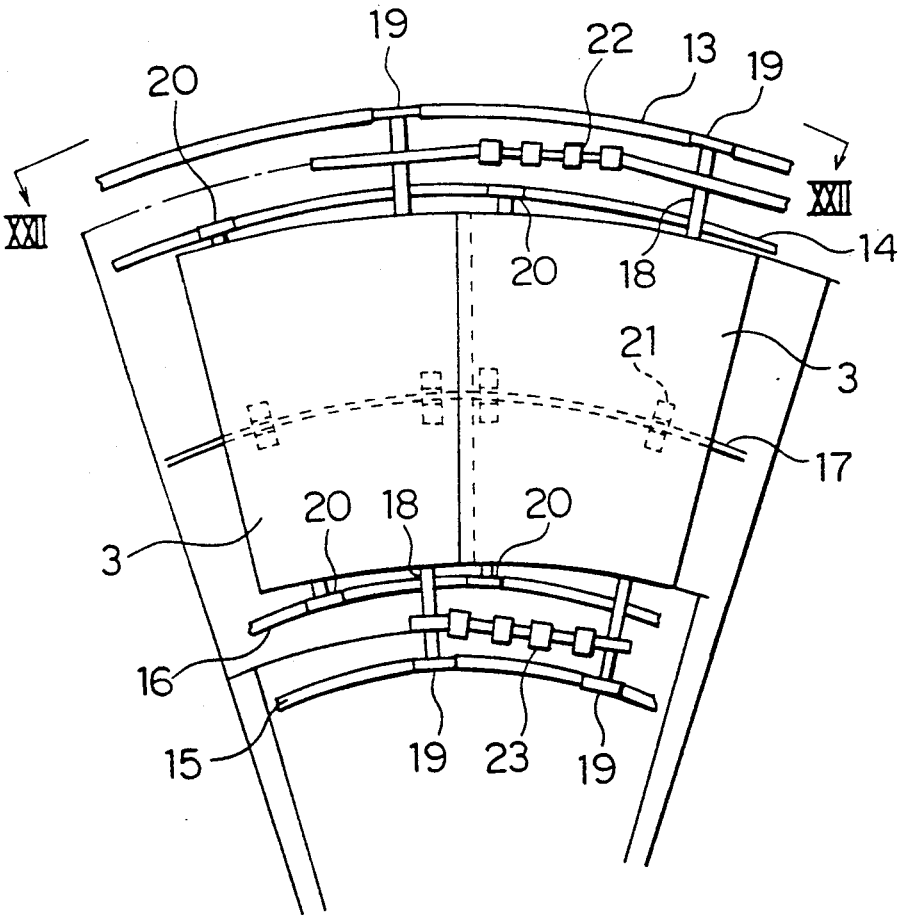
FIG. 21 PRIOR ART
FIG. 21 is a fragmental plan view of another conventional circular escalator apparatus.
Figure 22:
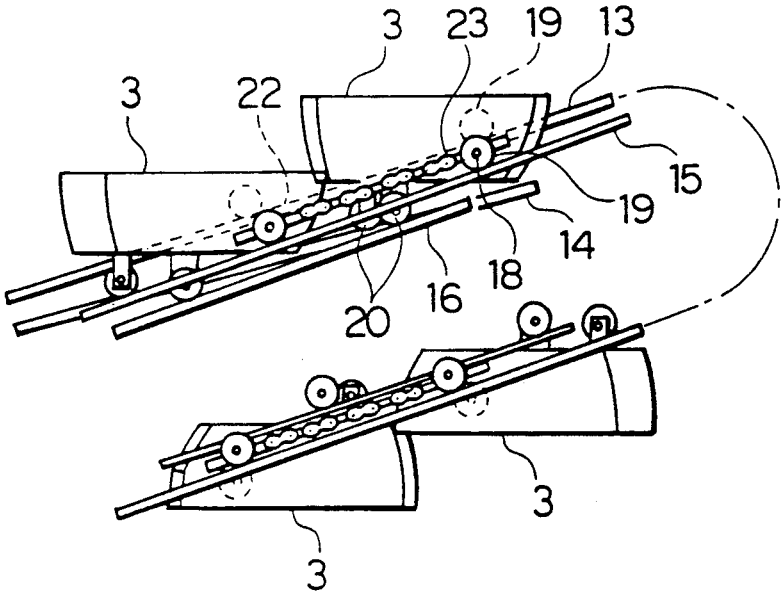
FIG. 22 PRIOR ART
FIG. 22 is a side view taken along line XXII—XXII of FIG. 21.
Figure 23:
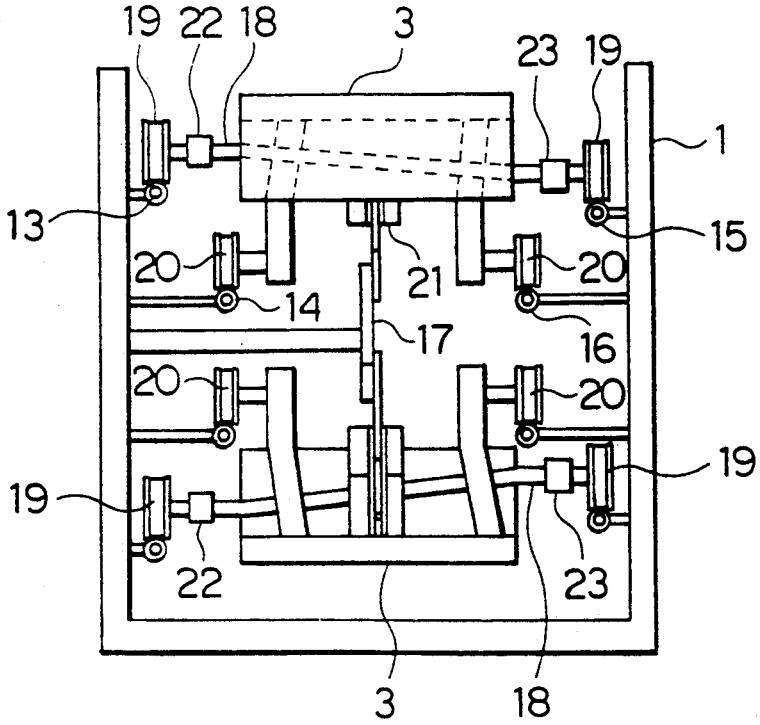
FIG. 23 PRIOR ART
FIG. 23 is a sectional view taken along a radial line in FIG. 21.
Figure 24:
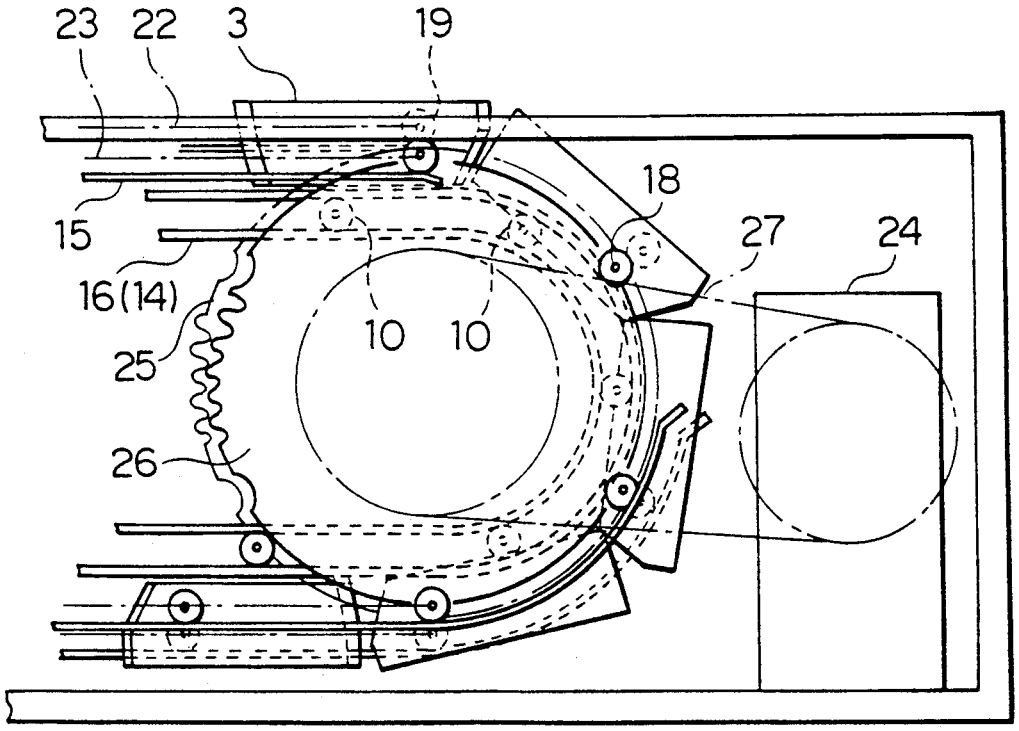
FIG. 24 PRIOR ART
FIG. 24 is a side view of the escalator steps in the turn-around portion.

Referring to FIGS. 14 and 15, dimension $l_1$ illustrated in FIG. 14 is the distance between the radially outer ends of the step axles 56 and dimension $l_2$ illustrated in FIG. 15 is the distance between the radially inner ends of the step axles 56, and therefore the relationship $l_1 > l_2$ holds.

Thus, with the curved escalator apparatus of the above embodiment of the present invention, since the transmission of the drive force to the steps 51 is achieved by the step chain 64 and the distance between the step axles 51 is limited by the outer and inner links 62 and 63, the driving of the steps and the positional control of the steps are independently achieved, so that the elongation of the step chain 64 is smaller than the elongation of the chains 22 and 23 due to aging of the conventional escalator apparatus, whereby the steps 51 can be smoothly driven in a good condition for a prolonged term.

Also, the dimension of the gap defined between the steps 51 is not related to the elongation of the step chain 64, and the amounts of elongation of the links 62 and 64 are very small as compared to those of the conventional chains 22 and 23, so that the gap between the steps 51 is prevented from being increased.

In the above embodiment, only one step chain 64 is provided, so that it is not necessary to consider the difference between the elongations of the outer and the inner chains as in the conventional design and the steps 51 can be driven in more reliable and better conditions. However, a plurality of step chains 64 may be provided as in the conventional design if it is desirable to do so.

Further, while the step chain 64 is illustrated as being one example of the drive force transmission mechanism, links with a rack gear may be provided to extend between the steps 51. In this case, a drive gear driven by the drive unit 24 and meshing with the rack may be provided within the constant slope section of the circulating path.

Also, a wire may be employed as the drive force transmitting mechanism.

Finally, the present invention can be equally applicable to a straight linear escalator apparatus.

As has been described, according to the present invention, a plurality of links disposed on side portions of each step to bridgingly connect the steps are provided. One end of each link is connected to a rotatable step axle disposed at a side surface of the step, and the other end of each link is slidably connected to a neighboring step through a slot and engaging member mechanism including an elongated slot formed in an edge portion extending along the edge portion of the step or the link and an engaging pin secured on the other end of the link or the edge portion of the step. Therefore, the escalator apparatus can be arranged with a relatively simple structure, and a high precision can be easily obtained regardless of the installation accuracy, so that a reliable and inexpensive escalator apparatus capable of smoothly driving the steps can be obtained.

Also, the escalator apparatus of the present invention may comprise a plurality of links disposed on side portions of each step to bridgingly connect the steps, and a drive force transmission means rotatably mounted to each of the steps and bridging each of the steps for transmitting drive power from a drive unit to the steps, with one end of each link being connected to a step axle rotatably mounted to a side face of a step, and the other end of the link being slidably connected to an arcuate slot having its center of curvature on the step axle of the neighboring step and formed in an edge portion of a neighboring step to extend along an edge portion of the step. Therefore, the amount of elongation of the drive force transmission mechanism and of all the links can be made smaller than that in the conventional design, whereby an escalator apparatus is obtained in which the step driving operation can be maintained in a good state for a prolonged term and the gap between the steps can be prevented from being increased.

What is claimed is:

1. An escalator apparatus including a plurality of links disposed on side portions of each step to bridgingly connect the steps, one end of each link being connected to a rotatable step axle disposed at a side surface of the step, and the other end of each link being slidably connected to a slot formed in an edge portion of a neighboring step and extending along an edge portion of the neighboring step.

2. An escalator apparatus as claimed in claim 1, wherein each step comprises a power transmission means for transmitting power from a drive unit.

3. An escalator apparatus as claimed in claim 2, wherein the steps are connected to each other by the links and the steps are driven by a drive force transmitted by the links, the escalator apparatus further comprising a guide rail for guiding the steps while relative positions of neighboring steps are changed by the links.

4. An escalator apparatus as claimed in claim 3, comprising engagement means mounted on the steps for guided engagement with the guide rail.

5. An escalator apparatus as claimed in claim 2, wherein each slot extends substantially perpendicularly with respect to a tread surface of the neighboring step.

6. An escalator apparatus as claimed in claim 4, wherein each step has first and second sides having one of the links provided thereon.

7. An escalator apparatus as claimed in claim 6, wherein the guide rail comprises a turn-around rail section, a sloped rail section, and a stepped portion between the turn-aroung rail section and the sloped rail section.

8. An escalator apparatus as claimed in claim 7, wherein the guide rail comprises a curved outer guide rail, the escalator apparatus further comprising a curved inner guide rail comprising a turn-around rail section, a sloped rail section, and a stepped portion between the turn-around rail section and the sloped rail section, the stepped portion in the inner guide rail being larger than the stepped portion in the outer guide rail.

9. An escalator apparatus as claimed in claim 3, wherein the guide rail for guiding the steps is sloped and curved.

10. An escalator apparatus comprising:

a plurality of steps each having a tread, a step axle extending parallel to the tread, and inner and outer sides; and a plurality of links disposed on the inner and outer sides of the steps, each of the links having a first end rotatably mounted on the step axle of one of the steps and a second end slidably engaged with a neighboring one of the steps by means of a slot formed in one of the link and the neighboring one of the steps and an engaging member formed on the other of the link and the neighboring one of the steps and slidably engaging the slot.

11. An escalator apparatus as claimed in claim 10 wherein each of the steps has a pin mounted thereon, and the second end of each link has an elongated slot that engages with the pin of a neighboring one of the steps.

12. An escalator apparatus as claimed in claim 11, wherein each step comprises a power transmission means for transmitting power from a drive unit.

13. An escalator apparatus as claimed in claim 12, wherein the steps are connected to each other by the links and the steps are driven by a drive force transmitted by the links, the escalator apparatus further comprising a guide rail for guiding the steps while relative positions of neighboring steps are changed by the links.

14. An escalator apparatus as claimed in claim 13, comprising engagement means mounted on the steps for guided engagement with the guide rail.

15. An escalator apparatus as claimed in claim 12, wherein each slot extends substantially perpendicularly with respect to the tread of a neighboring one of the steps.

16. An escalator apparatus as claimed in claim 14, wherein each step has first and second sides having one of the links provided thereon.

17. An escalator apparatus as claimed in claim 16, wherein the guide rail comprises a turn-around rail section, a sloped rail section, and a stepped portion disposed between the turn-around rail section and the sloped rail section.

18. An escalator apparatus as claimed in claim 17, wherein the guide rail comprises a curved outer guide rail, the escalator apparatus further comprising a curved inner guide rail comprising a turn-around rail section, a sloped rail section, and a stepped portion between the turn-around rail section and the sloped rail section, the stepped portion in the inner guide rail being larger than the stepped portion in the outer guide rail.

19. An escalator apparatus as claimed in claim 13, wherein the guide rail for guiding the steps is sloped and curved.

20. An escalator apparatus comprising:

a plurality of links disposed on side portions of each step for bridgingly connecting the steps; and a drive force transmission means rotatably mounted to each of the steps and bridging betweem each of the steps for transmitting drive power from a drive unit to the steps;

one end of each link being connected to a step axle rotatably mounted to side faces of one of the steps, and the other end of each link being slidably connected to an arcuate slot having its center on the step axle of a neighboring step and formed in an edge portion of the neighboring step to extend along an edge portion of the neighboring step.

21. An escalator apparatus as claimed in claim 20, wherein the steps are connected to each other by the links and the steps are driven by a drive force transmitted by the links, the escalator apparatus further comprising a guide rail for guiding the steps while relative positions of neighboring steps are changed by the links.

22. An escalator apparatus as claimed in claim 21, comprising engagement means mounted on the steps for guided engagement with the guide rail.

23. An escalator apparatus as claimed in claim 22, wherein each step has first and second sides having one of the links provided thereon.

24. An escalator apparatus as claimed in claim 23, wherein the guide rail comprises a turn-around rail section, a sloped rail section, and a stepped portion disposed between the turn-around rail section and the sloped rail section.

25. An escalator apparatus as claimed in claim 24, wherein the guide rail comprises a curved outer guide rail, the escalator apparatus further comprising a curved inner guide rail comprising a turn-around rail section, a sloped rail section, and a stepped portion between the turn-around rail section and the sloped rail section, the stepped portion in the inner guide rail being larger than the stepped portion in the outer guide rail.

26. An escalator apparatus as claimed in claim 21, wherein the guide rail for guiding the steps is sloped and curved.

27. An escalator apparatus comprising:

a main frame defining a sloped, curved path having an upper load-bearing run and a lower return run;

a plurality of steps disposed on the main frame along the path, each of the steps having a link engaging portion and an edge portion having a slot extending along the edge portion;

transmission means for transmitting a drive force to the steps;

a guide rail mounted on the main frame for guiding the steps; and a plurality of links, each of the links having a first end connected to the link engaging portion of one of the steps and a second end slidably engaging the slot in a neighboring one of the steps.

28. An escalator apparatus as claimed in claim 27, comprising engagement means mounted on the steps for guided engagement with the guide rail.

29. An escalator apparatus as claimed in claim 27, wherein each link engaging portion comprises an axle mounted to each side surface of one of the steps.

30. An escalator apparatus as claimed in claim 27, wherein each slot extends substantially perpendicularly with respect to a tread surface of the step in which the slot is formed.

31. An escalator apparatus as claimed in claim 27, wherein each slot comprises an arcuate slot having a center of curvature on the step axle of the neighboring step.

32. An escalator apparatus as claimed in claim 28, wherein each step has first and second sides having one of the links provided thereon.

33. An escalator apparatus as claimed in claim 32, wherein the guide rail comprises a turn-around rail section, a sloped rail section, and a stepped portion disposed between the turn-around rail section and the sloped rail section.

34. An escalator apparatus as claimed in claim 27, wherein the circulating path of the main frame is curved.

35. An escalator apparatus as claimed in claim 33, wherein the guide rail comprises a curved outer guide rail, the escalator apparatus further comprising a curved inner guide rail comprising a turn-around rail section, a sloped rail section, and a stepped portion between the turn-around rail section and the sloped rail section, the stepped portion in the inner guide rail being larger than the stepped portion in the outer guide rail.

36. An escalator apparatus comprising:

a main frame defining a sloped, curved path having an upper load-bearing run and a lower return run;

a plurality of steps disposed on the main frame along the path, each of the steps having a tread and inner and outer sides;

transmission means for transmitting a drive force to the steps;

a guide rail mounted on the main frame for guiding the steps; and a plurality of links disposed on the inner and outer sides of the steps, each of the links having a first end rotatably mounted on one of the steps for rotation about an axis parallel to the tread of the one of the steps and a second end slidably mounted on a neighboring one of the steps by means of a slot formed in one of the link and the neighboring one of the steps and an engaging member formed on the other of the link and the neighboring one of the steps and slidably engaging the slot.

37. An escalator apparatus as claimed in claim 36 wherein:

each of the steps has an edge portion with a pin mounted thereon; and the first end of each link is rotatably connected to one of the steps and the second end of each link has a slot formed therein that slidably engages the pin on a neighboring one of the steps.

38. An escalator apparatus as claimed in claim 37, comprising engagement menas mounted on the steps for guided engagement with the guide rail.

39. An escalator apparatus as claimed in claim 37, wherein each link engaging portion comprises an axle mounted to each side surface of one of the steps.

40. An escalator apparatus as claimed in claim 37, wherein each slot extends substantially perpendicularly with respect to the tread a neighboring one of the steps.

41. An escalator apparatus as claimed in claim 38, wherein each step has first and second sides having one of the links provided thereon.

42. An escalator apparatus as claimed in claim 41, wherein the guide rail comprises a turn-around rail section, a sloped rail section, and a stepped portion disposed between the turn-around rail section and the sloped rail section for defining a level difference therebetween.

43. An escalator apparatus as claimed in claim 37, wherein the circulating path of the main frame is curved.

44. An escalator apparatus as claimed in claim 42, wherein the guide rail comprises a curved outer guide rail, the escalator apparatus further comprising a curved inner guide rail comprising a turn-around rail section, a sloped rail section, and a stepped portion between the turn-around rail section and the sloped rail section, wherein the stepped portion in the inner guide rail is larger than the stepped portion in the outer guide rail.

* * * * *